US007063335B1

(12) United States Patent
Galeev

(10) Patent No.: US 7,063,335 B1
(45) Date of Patent: Jun. 20, 2006

(54) IN-LINE ROLLER SKATE

(76) Inventor: Felix Galeev, 7215 18th Ave., Brooklyn, NY (US) 11204

( * ) Notice: Subject to any disclaimer, the term of this patent is extended or adjusted under 35 U.S.C. 154(b) by 35 days.

(21) Appl. No.: 10/727,218

(22) Filed: Dec. 3, 2003

(51) Int. Cl.
*A63C 17/14* (2006.01)

(52) U.S. Cl. ..... 280/11.204; 280/11.221; 280/11.231; 280/11.206

(58) Field of Classification Search ..... 280/11.19, 280/11.204, 11.205, 11.206, 11.208, 11.209, 280/11.221, 11.223, 11.226, 11.227, 11.231, 280/11.232, 11.27
See application file for complete search history.

(56) References Cited

U.S. PATENT DOCUMENTS

| | | | | | |
|---|---|---|---|---|---|
| 862,431 | A | | 8/1907 | Armband | |
| 899,963 | A | * | 9/1908 | Ferguson | 280/11.206 |
| 904,088 | A | | 11/1908 | Rother | |
| 1,260,692 | A | | 3/1918 | Madsen | |
| 1,572,567 | A | * | 2/1926 | Skorka | 280/11.221 |
| 1,778,850 | A | | 10/1930 | Duisenberg | |
| 1,868,548 | A | * | 7/1932 | Turner | 280/11.209 |
| 1,988,055 | A | | 1/1935 | Stein | |
| 2,048,916 | A | * | 7/1936 | Bentzlin | 280/11.221 |
| 3,351,353 | A | * | 11/1967 | Weitzner | 280/7.13 |
| 3,522,951 | A | * | 8/1970 | Tyson | 280/842 |
| 4,076,263 | A | | 2/1978 | Rand | |
| 4,149,735 | A | | 4/1979 | Blackburn | |
| 4,572,529 | A | * | 2/1986 | Thomas | 280/843 |
| 4,909,523 | A | | 3/1990 | Olson | |
| 5,207,454 | A | * | 5/1993 | Blankenburg et al. | 280/843 |
| 5,308,093 | A | * | 5/1994 | Walin | 280/11.207 |
| 5,472,218 | A | * | 12/1995 | Pratt | 280/11.209 |
| 5,486,011 | A | * | 1/1996 | Nelson | 280/11.207 |
| 5,505,470 | A | * | 4/1996 | Hoshizaki | 280/11.232 |
| 5,549,331 | A | * | 8/1996 | Yun et al. | 280/843 |
| 5,671,931 | A | * | 9/1997 | Su | 280/11.232 |
| 5,716,074 | A | * | 2/1998 | Theodorou | 280/843 |
| 5,738,360 | A | * | 4/1998 | Petell et al. | 280/11.232 |
| 5,873,583 | A | * | 2/1999 | Moore | 280/11.201 |
| 5,964,469 | A | | 10/1999 | Grossman | |
| 6,015,157 | A | * | 1/2000 | Hilgarth | 280/11.27 |
| 6,065,762 | A | | 5/2000 | Brelvi | |
| 6,293,565 | B1 | * | 9/2001 | Bouchard et al. | 280/11.226 |
| 6,425,588 | B1 | * | 7/2002 | Holland | 280/11.208 |
| 6,491,308 | B1 | * | 12/2002 | Bakx | 280/11.226 |

FOREIGN PATENT DOCUMENTS

| | | |
|---|---|---|
| DE | 494395 | 3/1930 |
| EP | 0232065 | 8/1987 |

* cited by examiner

*Primary Examiner*—Christopher P. Ellis
*Assistant Examiner*—Kelly E Campbell
(74) *Attorney, Agent, or Firm*—Boris Leschinsky

(57) ABSTRACT

An in-line roller skate is disclosed to include a frame with a curved lower portion, which supports a point stop at the front end followed by a ball support, a string of rotating rollers and a tail ball support. The point stop is preferably another roller fixed in position. The in-line skate allows performing all the maneuvers as the regular ice skate without significant additional training and therefore can be used advantageously during off-season training by ice skaters as well as for a broad range of recreational activities.

9 Claims, 3 Drawing Sheets

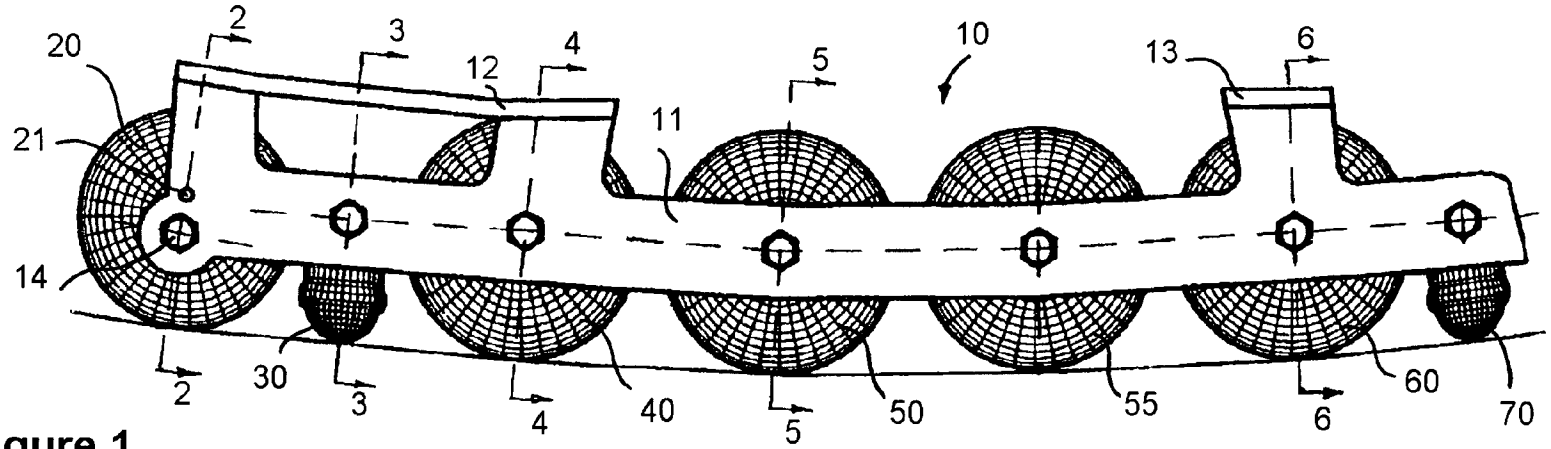
Figure 1
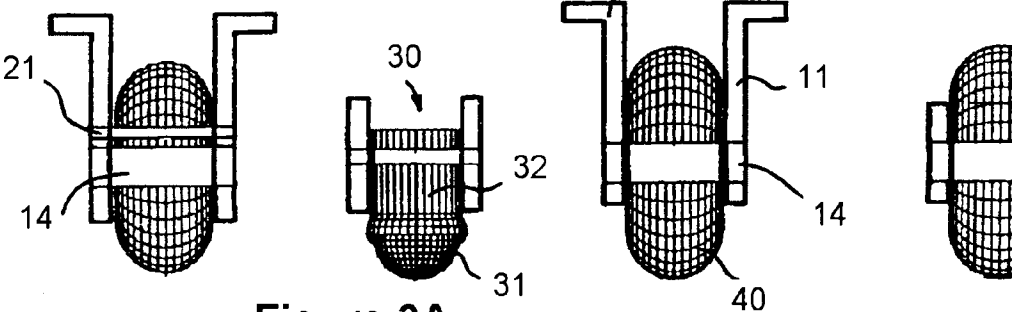
Figure 2
Figure 3A
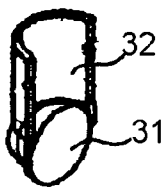
Figure 3B
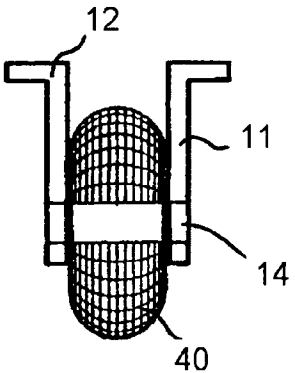
Figure 4
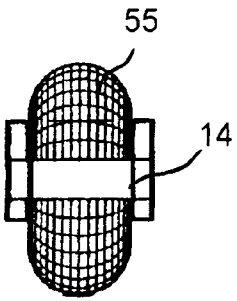
Figure 5
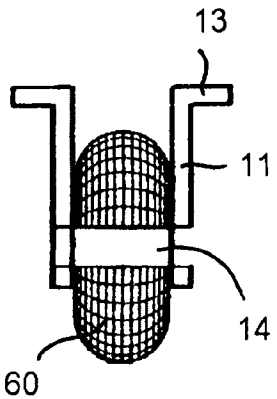
Figure 6

IN-LINE ROLLER SKATE

BACKGROUND OF THE INVENTION

The present invention relates to in-line or so-called tandem roller skates and comprises a faster and more smoothly operating in-line roller skate, which is easily manufactured and more durable under both normal and extreme operating conditions. The present invention has a particular advantage for those users seeking to have all the movement options available normally only to the users of ice skates.

In-line roller skates typically utilize two or more wheels positioned to rotate within a common, vertical plane and while operating as roller skates have much of the feel and behavior associated with ice skates. Substantially the same body movements are required to operate both ice and in-line roller skates, and such roller skates have become increasingly popular with ice skaters as a desirable training tool for off season and on-street use. In recent years, they have been capturing an increasing share of the recreational skate market and in time may parallel jogging as a healthy and pleasurable adult sport.

It is desirable therefore to have an in-line skate capable of all the same movements as a regular ice skate, preferably by using the same movements of the body so that a single user can seamlessly switch between the ice skate and the in-line skate.

In-line skates are well known and appear at least as early as 1876 in the U.S. Pat. No. 7,345 of C. W. Saladee, which disclosed a two-wheel in-line model featuring a somewhat complex, spring loaded carriage supporting laterally pivoting rollers for improved maneuverability and even distribution of skater weight but was heavy, noisy and quite complicated to manufacture and assemble.

In 1946, the U.S. Pat. No. 2,412,290 to Rieske disclosed a heavy metal framed, three-wheel, in-line skate for indoor use which featured an endless, rubberized belt so as to avoid damage to wooden floors. The belt rotated on three pulley-like wheels wherein the intermediate wheel was vertically adjustable to produce a rocking action in a forward or rearward direction, which made it easier to steer and maneuver the skate. Vertical adjustment of the intermediate wheel was achieved by a clamping bolt and a system of interlocking teeth and allowed a range of vertical adjustment.

In 1966, G. K. Ware in the U.S. Pat. No. 3,287,023 disclosed an in-line skate with thin, rounded wheels, which endeavored to simulate the performance of ice skates. The Ware skate utilized a fairly heavy metal frame having front and rear frame members with longitudinally extending and overlapping sections. Three sections had a multiplicity of horizontally arranged axle apertures which permitted positioning of wheel axles in a variety of different locations and provided continuous adjustability of the frame to accommodate a wide variety of boot sizes. The Ware frame also included the positioning of apertures at several elevations at the front and rear of the skate so that the forward and rear wheels could be at a higher level than the two intermediate wheels. The Ware frame and variations of it are still in use on currently available in-line roller skates and has been the best all around frame available for such skates.

The U.S. Pat. No. 4,492,385 to Olson disclosed a hybrid skate combining the desirable features of both ice and roller skates and featured a mounting system which could carry either the traditional ice skating blade or a series of in-line wheels.

Other in-line roller skates with various wheel structures and configurations are shown in U.S. Pat. Nos. 3,880,441, 3,900,203, 3,963,252, and 4,618,158. A number of distinct wheel structures have been developed for use with in-line skates, conventional roller skates and other roller devices, some of which are shown in U.S. Pat. Nos. 189,783, 2,670,242, 4,054,335 and 4,114,952 incorporated herein by reference.

The use of one or multiple ball supports on one or both ends of the in-line skate is known from a number of patents. U.S. Pat. No. 862,431 by Armband shows an in-line skate with a ball at the rear end of the skate. Blankenburg also shows several balls incorporated into the design of his skate as shown in the U.S. Pat. No. 5,207,454. The general concept is to increase the ability of the user to do turns in a similar way as the ice skaters do.

Although most of the designs of in-line roller skates incorporate the string of rollers positioned along a straight line for improved stability, some designs attempt to mimic the curved design of some ice skates and position the rollers along a curved line. For example, the U.S. Pat. No. 5,964,469 by Grossman shows one such design where at least two front wheels and two rear wheels are suspended at a point higher than the main string of rollers. Stein in the U.S. Pat. No. 1,988,055 describes a similar concept so as Madsen in the U.S. Pat. No. 1,260,692. Some of these patents also describe the use of rollers of different diameters to accommodate the curvature of the skate.

Despite many attempts to create an in-line skate with all the same characteristics as the ice skate, such design has never been achieved. The need therefore still exists for an in-line skate allowing the user to perform substantially all the same movements as with the ice skate. The need also exists for such a skate to have a simple and easily manufacturable design incorporating preferably all the known elements from traditional in-line skates.

SUMMARY OF THE INVENTION

Accordingly, it is an object of the present invention to overcome these and other drawbacks of the prior art by providing a novel in-line skate allowing the user to perform all the movements from the repertoire of ice skaters.

It is another object of the present invention to provide a novel in-line skate, which is easy to produce and which incorporates traditional elements used in building modern in-line skates.

It is a further object of the present invention to provide a novel in-line skate allowing the advanced ice skaters to train during the off season without limiting their ability to perform their ice skating routine, including steps, jumps, and others.

It is yet a further object of the present invention to provide a novel design of an in-line skate, which does not require any different training for its use than that for traditional ice skates.

The in-line roller skate of the invention contains a plurality of rollers and ball supports aligned along the skate boot in a particular order to provide all the features of an ice skate. The base of the skate forms a housing to support the following elements of the skate positioned along a curvature of a particular shape: first, starting from the front of the skate, there is positioned a so-called point stop. A standard roller fixed in its position to prevent its rotation can be used for a point stop. Alternately, a plastic or hard rubber pointed bushing can also be used therefor. The purpose of the point stop is to support the weight of the user when the foot is bent backwards and the entire body is supported on a single point.

The point stop is designed for jumps and rotation of the user about the most distal point of the skate.

A front spherical or ball support element follows along a curved line behind the point stop. It is designed to support the user weight when a rotation described above is performed. The user can use either the point stop alone or in combination with the front ball support to perform such rotation. The curvature of the skate is such that in that case no other element of the skate is touching the flat surface under the user.

Following the front ball support is a string of standard rollers designed to support the main weight of the user during a variety of maneuvers performed typically by the skater such as moving back and forth, turning, riding along an arch etc. The curvature of the skate is such that the user may optionally lean either only on several rollers at the same time or on the front rotating roller and a front ball support.

Following the main string of rollers is a tail ball support designed to allow for turning and rotating about the tail portion of the skate during rolling backwards. The curvature of the skate towards the tail portion thereof is such that it allows the user to stand only on the tail ball support or in combination thereof with the last roller.

A traditional in-line skate break may optionally conclude the design of the skate of the present invention.

BRIEF DESCRIPTION OF THE DRAWINGS

A more complete appreciation of the subject matter of the present invention and the various advantages thereof can be realized by reference to the following detailed description in which reference is made to the accompanying drawings in which:

FIG. 1 is a general side view in cross-section of the skate of the invention showing all the major elements thereof;

FIG. 2 is a cross-sectional view of the point stop element of the skate of the present invention taken along line 2—2 on FIG. 1;

FIGS. 3A and 3B show respectively a cross-sectional and a cutout view of the front ball support element of the skate of the invention taken along line 3—3 on FIG. 1;

FIG. 4 is a cross-sectional view of the front roller of the skate of the present invention taken along line 4—4 on FIG. 1;

FIG. 5 is a cross-sectional view of the general in-line roller of the skate of the present invention taken along line 5—5 on FIG. 1;

FIG. 6 is a cross-sectional view of the last roller of the skate of the present invention taken along line 6—6 on FIG. 1;

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 7:
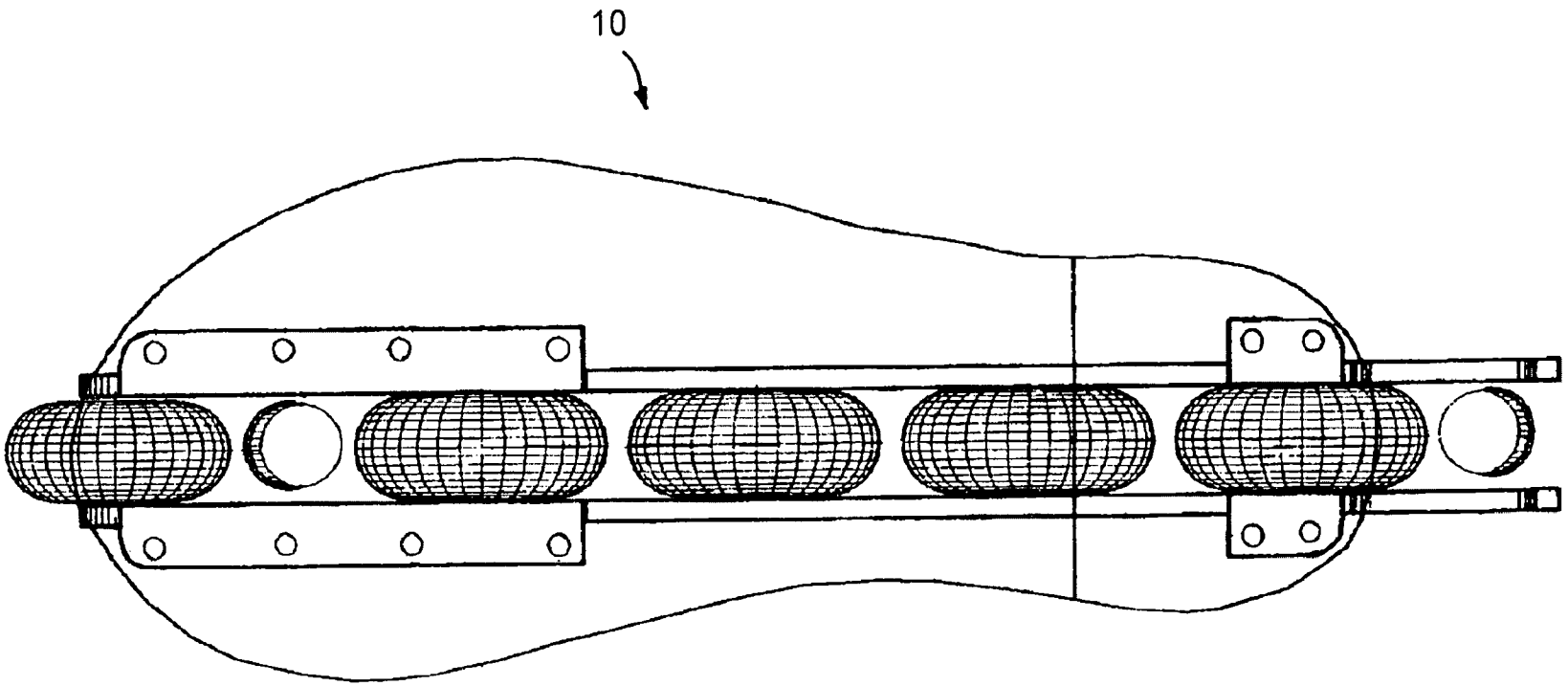
FIG. 7 is a bottom view of the skate of the invention.
Figure 8:
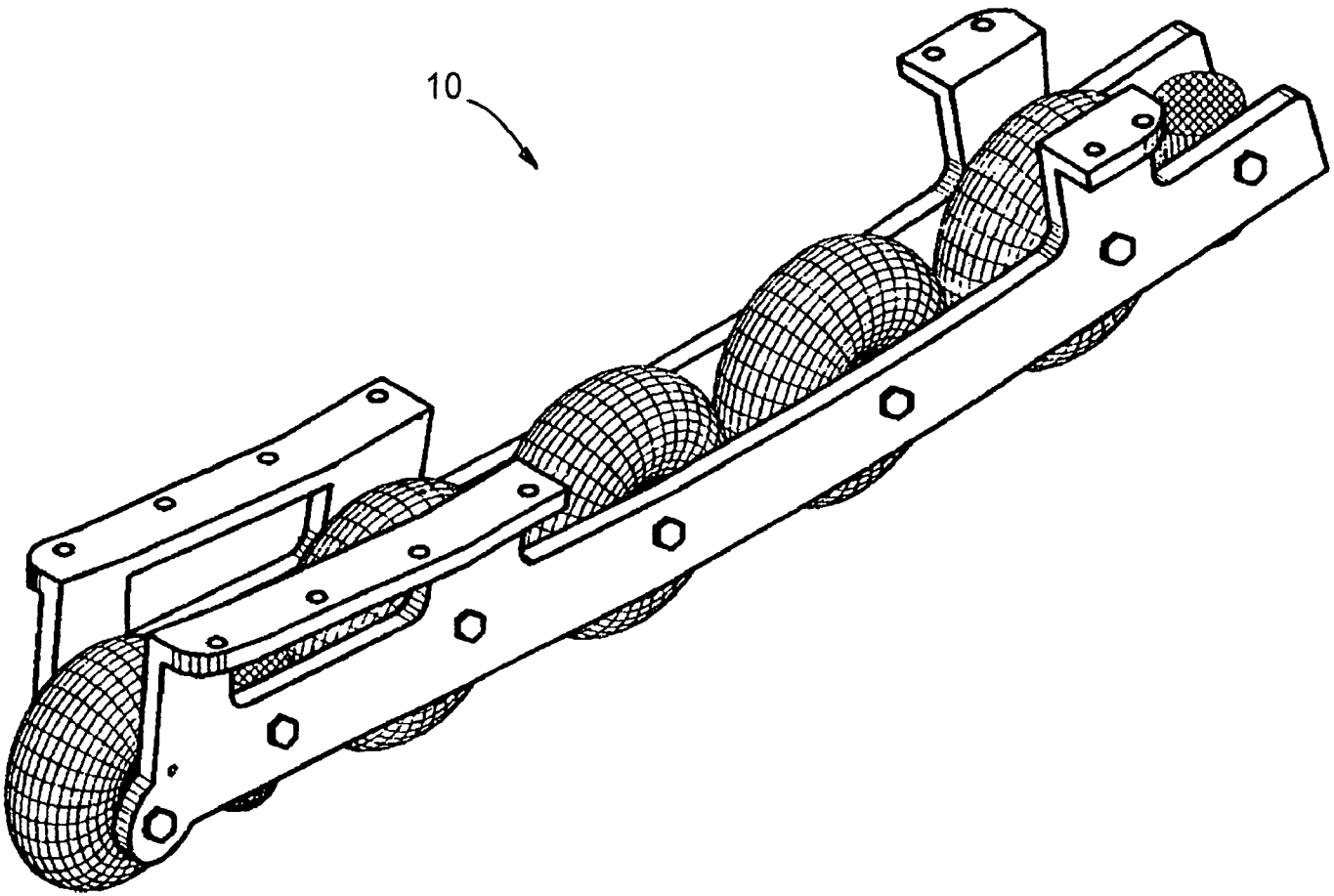
FIG. 8 is a side view of the skate of the invention in its full assembly.

FIGS. 1, 7, and 8 illustrate the full assembly of the roller skate 10 of the invention. It includes a frame 11 supporting all elements of the skate. The frame is typically made from metal such as stainless steel to prevent it from rusting and ensure its durability. Alternatively, a lower weight metal or a hard polymer can be used to make the frame 11. The frame 11 has a front end characterized by a front boot attachment portion 12 and a tail end characterized by the rear boot attachment portion 13. The boot itself is not shown on the drawings, as it is a well-known element of the skate. The front boot attachment 12 can optionally be made longer to span the distance between the front point stop 20 and the first rotating roller 40 of the skate 10. Both the front attachment 12 and the tail attachment 13 contain provisions for connecting the frame to the boot such as for example the openings for the attachment screws.

The lower portion of the frame 11 is designed to support the balls and rollers of the skate. Optionally, as will be described in detail below, the lower portion of the frame 11 is made with a curvature to accommodate the most preferred position of the balls and rollers of the skate.

The following is a description of the skate elements going from the front of the skate towards the tail of the skate. The very first component at the front of the skate is the point stop 20. It can be realized as a simple roller (as shown on FIGS. 1 and 2), which is fixed in position by the pin 21 and thus prevented from rotation about its axis 14. Alternatively, a tapered bushing made from plastic or hard rubber may be placed in the front of the skate instead of the fixed roller. The function of the pointed stop is to allow the user to both stop and jump off this point stop when the skate is tilted towards the front end. The user also can perform a rotation about the point stop 20 as only a point contact is realized with the underlying surface. The roller used for this function is optionally made smaller in diameter than other rollers of the skate so as to minimize the height of the frame 11 and to accommodate its curvature. As the material of the roller is removed due to abrasion, the pin 21 may be removed temporarily to allow the roller to be turned to expose a fresh portion thereof at which point the pin 21 is placed back in its position.

Following the point stop 20 there is placed a front ball support element 30 as shown in detail on FIGS. 3A and 3B. The design of the ball support element 30 is similar to that described in the prior art as mentioned above and generally comprises a housing 32 made preferably from two halves or with some other provisions to replace the ball 31 enclosed therein. The ball 31 is supported by the housing 32 such that it is allowed to rotate freely in any direction.

The curvature of the frame 11 in the front portion of the skate is such that by tilting the skate forward, the user can lift all the other elements of the skate in the air while supporting himself only on the point stop 20 defining a first point of contact between the skate and the underlying surface and the ball support 30 defining the second point of contact. Therefore, two points of contact are present when performing various skating maneuvers including rotations and jumps. Mathematically, the curve has to be drawn such as to satisfy the condition that the lowest point of the ball support 30 has to be below the tangential line drawn from the point stop 20 to the first roller 40. The importance of the point stop 20 and the front ball support 30 along with the presence of the curvature in the frame of the roller skate of the invention is that the user can perform such important maneuvers as steps, jumps off the front of the skate and rotations about the point stop 20.

Following the front ball support 30 there is a string of rotating rollers constituting the main portion of the skate 10 and shown in detail on FIGS. 4, 5, and 6. The string comprises the first rotating roller 40, intermediate rollers 50 and 55, and the last rotating roller 60. Optionally, only one intermediate roller may be present or if needed several intermediate rollers may be used depending on the size of the skate and its application for adults or children. Preferably, all the rollers in the string are made from the same material and have the same diameter although the use of rollers with different diameters is also contemplated herein. The front roller 40 may be placed under the front boot attachment 12 so as to distribute evenly the load of the frame 11 as shown in more detail on FIG. 4. Rollers 50 and 55 are placed along the frame 11, which preferably supports the transverse axis 14 thereof on both sides. Preferably, the location of the rollers within the string is evenly spaced out with the distance between thereof ranging between 1 and 3 inches. That distance is preferably being greater than the distance between the point stop 20 to the front ball support 30 and the distance between the ball support 30 to the first roller 40 both of which range from about half an inch to about 2 inches. That allows for faster steps and jumps as less tilting forward is required by the user in order to lift the string off the surface.

The curvature along the string of rotating rollers 40 through 60 is such as to allow the user to skate only on the rollers without involving the front 30 or the rear ball support 70. That curvature allows performing the main element off figure skating, namely rolling along an arch. Also, it allows making movements needed for playing hockey.

Finally, behind the last rotating roller 60 there is shown a tail ball support element 70 equal in design to the front ball support 30. The tail ball support 70 is located in close proximity to the last rotating roller 60 (closer preferably than the roller 55) along the general curvature of the frame 11. That curvature is chosen such that the user can stand only on the tail ball support 70 and the last rotating roller 60 while having all other elements of the skate in the air by tilting the skate backwards. This allows backward rotations about thereof as well as rolling along the arch while moving backwards thus completing the list of maneuvers that can be performed by ice skaters.

The present in-line skate can be advantageously used for all types of sports and pleasurable activities associated with the use of ice skates including single figure skating, pair figure skating, dances on ice, ice hockey, and others. The design of the skate of the present invention allows to perform all the complicated maneuvers of ice skates including steps, jumps from both forward and backward movements, rolling along a convex or concave curve, rolling forwards and backwards, etc.

Although the invention herein has been described with respect to particular embodiments, it is understood that these embodiments are merely illustrative of the principles and applications of the present invention. For example, a modification of the present invention utilizing pairs of rollers rather than single rollers arranged in-line is fully contemplated herein. A tail end brake may also be optionally incorporated into the design of the skate. It is therefore to be understood that numerous modifications may be made to the illustrative embodiments and that other arrangements may be devised without departing from the spirit and scope of the present invention as defined by the appended claims.

What is claimed is:

1. An in-line roller skate comprising:

a frame having a front end and a tail end, said frame having attachment means adapted to secure said frame to a boot, said fame having a longitudinally curved lower portion, a point stop located at the front end of said frame along said curved lower portion, a front ball support located adjacent and behind said point stop at the front end of said frame along said curved lower portion, a plurality of rotating rollers located behind said front ball support along said curved lower portion of said frame each of said rollers rotatably supported about an axis affixed perpendicularly to the frame, and a tail ball support located at the tail end of said frame along the curved lower portion thereof, whereby said rotating rollers can only rotate in a plane defined by the curvature of the frame while said front and said tail ball supports can turn in any direction, at least two points of contact with an underlying surface are present while using said in-line roller skate to perform various skating maneuvers including rotations and jumps, a first point of contact being said point stop on said front end of said frame, and a second point of contact being said front ball support.

2. The roller skate as in claim 1, wherein said point stop is a roller fixed in position by a removable pin located away from the axis of rotation of said roller.

3. The roller skate as in claim 1, wherein said point stop is a tapered bushing.

4. The roller skate as in claim 1, wherein said plurality of rotating rollers further comprising a first rotating roller placed towards the front end of said frame, at least one intermediate rotating roller, and a last rotating roller.

5. The roller skate as in claim 4, wherein the distance between the rollers of said plurality of rotating rollers is greater than the distance between said first rotating roller and said front ball support.

6. The roller skate as in claim 4 wherein the rollers of said plurality of rotating rollers are spaced apart evenly at a distance between the rollers ranging from about 1 to about 3 inches.

7. The roller skate as in claim 4, wherein the distance between the first rotating roller and said front ball support is about half to about two inches.

8. The roller skate as in claim 4, wherein the distance between the tail ball support and the last rotating roller is less than the distance between the rotating rollers of said plurality.

9. The roller skate as in claim 1, wherein the lower curved portion of said frame defining a curvature sufficient to allow support of the skate only by said point stop and said front ball support.

* * * * *